United States Patent [19]

Hofsäss

[11] Patent Number: 4,563,667

[45] Date of Patent: Jan. 7, 1986

[54] TEMPERATURE AND/OR CURRENT SENSITIVE ELECTRICAL SWITCH

[76] Inventor: Peter Hofsäss, Strietweg 45, 7530 Pforzheim, Fed. Rep. of Germany

[21] Appl. No.: 530,700

[22] Filed: Sep. 9, 1983

[30] Foreign Application Priority Data

Sep. 16, 1982 [DE] Fed. Rep. of Germany ..... 3234373

[51] Int. Cl.[4] ..... H01H 37/12; H01H 37/52

[52] U.S. Cl. ..... 337/349; 337/370

[58] Field of Search ..... 337/95, 96, 335, 336, 337/362, 370, 371, 372, 380, 53, 89, 112, 343, 365, 342, 349

[56] References Cited

U.S. PATENT DOCUMENTS

| | | | |
|---|---|---|---|
| 2,698,368 | 12/1954 | Lehr et al. | 337/371 |
| 2,724,753 | 11/1955 | Miles | 337/349 |
| 3,033,960 | 5/1962 | Geller | 337/95 |
| 4,445,105 | 4/1984 | Wehl | 337/370 |

*Primary Examiner*—Harold Broome

*Attorney, Agent, or Firm*—Antonelli, Terry & Wands

[57] ABSTRACT

For stopping drift or other undesired changes in the response temperatures of a thermal switch using a bimetallic element for driving a moving contact, the design is such that the moving contact and a counter-contact are supported on a common insulating supporting part and the counter-contact is elastically and yieldingly fixed on the supporting part. The lengths of the bimetallic element and of the a strip supporting the counter-contact that may be moved are different to each other so that the two contacts will make contact at different points thereon and with a rubbing effect for clearing oxide and other undesired coatings forming on the said contacts.

For producing such a thermal switch with multiple functions, for example the functions of a temperature automatic controller and a thermal protective device, the counter-contact, that is placed so that it may give way elastically, is acted upon by a further bimetallic element.

13 Claims, 8 Drawing Figures

TEMPERATURE AND/OR CURRENT SENSITIVE ELECTRICAL SWITCH

BACKGROUND OF THE INVENTION

The present invention is with respect to temperature and/or current sensitive electrical switch, such as a theremostat or thermal protection switch or the like, having at least one moving contact, adapted to be moved by a bimetallic element on the temperature increasing or decreasing past a certain limit, a counter-contact and terminals for connection with leads.

DISCUSSION OF THE PRIOR ART

In the prior art such switches, as for example those that are normally closed so that in the low temperature condition the contact and the counter-contact are touching producing the desired electrical connection, the moving contact is pressed more and more strongly against the contact so that there is a strong chance of irreversible changes in the switch being caused, more specially deformation of its parts so that the switching temperatures are no longer within the desired tolerances.

OUTLINE OF THE INVENTION

It is for this reason that one purpose of the invention is designing such a switch device that while on the one hand the switch may be simply manufactured, it is so designed that there is little chance of drift in the switching or response temperature.

In the invention, for effecting this and other purposes or objects, a switch device of the sort noted hereinbefore it so designed that the contact and the counter-contact are joined with terminal elements, that are spaced by an insulating supporting part (common to the said elements) and in that the counter-contact is supported elastically and givingly on the supporting part. The switch device may be designed to be normally closed or normally open; that is to say, the connection between the contact and the counter-contact may be broken when the temperature goes up to over a given switching temperature, as for example when the device is a thermal protection switch on a motor or the like, or is a thermostat as used in a heating system, whereas at a temperature under the switching temperature it will be closed; it is furthermore possible for the contacts to be opened at a temperature under the switching temperature and to be closed at a temperature over the switching temperature, as will be the case for example when the device is used as part of a refrigeration system or the like. As a general point, the bimetallic element may be itself a conductor of electricity and may possibly be designed as a current-sensitive switch, so that in this case the switching operation will not be produced by the temperature of the surroundings but because of the heat produced by the flow of current through it. In this case the device will naturally enough only be opened when the amount of heat is overgreat, such heat naturally only being produced as long as the device is closed. As a further general point, forms of the invention will be possible in which the current is conducted by way of other elements to the moving contact, there being a number of different known ways of doing this.

In keeping with a preferred form of the invention, the supporting part is in the form of a ring and on the one hand has a generally round bimetallic element on its outer edge, said element switching the moving contact, and on the other hand it has an elastic belville washer with the counter-contact thereon, said washer resting against the outer edge of same. In keeping with a further form of the invention it is possible for the counter-contact to be on one end of a long, narrow or elongated elastic strip, of which a part, at some distance from the counter-contact, is being supported on the supporting part; the bimetallic element has the contact on one end thereof, its other end being supported and kept in place by being fixed frictionally on the supporting part. In this respect still further outgrowths of the general idea of the invention are possible such that the counter-contact strip is made in one piece with its terminal element and the bimetallic element is joined up with a conducting part, the same being on the one hand frictionally kept in position on the supporting part and on the other forming, as a single part thereof, a terminal element for the moving contact and/or on the supporting part there are undercut lips. Furthermore the connection piece, joined with the bimetallic element, has edges bent out of its plane and so slipped into position in the undercuts between the lips and a middle part of the supporting part that there is a gripping effect so that the edges are kept against the lips and the connection piece in the more limited sense is gripped against the middle part of the supporting part, and furthermore on the counter-contact strip in one part thereof there are edges like the edges on the connection piece so that the said part is gripped and kept in position at its edges in the undercuts as noted hereinbefore. In these forms of the invention the switch device may be looked upon as a step forward from the point of view of production engineering. The contact unit made up of the contact, the bimetallic element, the connection piece joined with same and the terminal part formed with the last-named in one piece, on the one hand and on the other hand the counter-contact unit made up of the counter-contact and the counter-contact strip together with the joining piece formed in one piece therewith, only have to be pressed into the ready-made supporting part with a force fit, the terminal elements being pushed into the spaces between the two lips. The switch made in this way is then quite ready to be fixed at the position where it is to be used. In this respect the terminal elements may be bent before fixing to the supporting part or afterwards in the desired way, the later fixing operation being of value when an end plate is formed on the supporting part, round whose edge the terminal elements are then best crimped. The assembly of the parts as noted may be undertaken fully automatically. In place of fixing the switch as so far assembled and as it is at the position where it is to be used, it may be placed in a housing, in which event a cover will then be formed by a front end (possibly forming an end plate) of the supporting part, whereas the rest of the housing will be pocket-like. The terminal elements are run out from between the end plate and the housing and sealed at the position where they go through the housing structure.

Certain trouble conditions are in some cases likely with such a device because of the electrical connection between the contact and the counter-contact becoming less good because of corrosion or because of dirt at the point at which contacting takes place, this being more specially the case when the device is not sealed off in a separate casing but is simply placed on a motor or the like without any sort of cover, where corrosion or contamination is not out of the question. For this reason a further purpose of the invention is making such a further development of the device of the sort noted that there is no chance of the contacts becoming coated with materials cutting down, or cutting off completely, the flow of current between the contacts or making it possible for such undesired coatings, if formed, to be taken off and the parts cleaned. In keeping with the invention this purpose is effected by a form of the device such that the freely moving parts of the bimetallic element and of the counter-contact strip are different in length. Because of the different free lengths of the arms of the parts with the contact and the counter-contact on them, that is to say on the one hand of the bimetallic element (for example) having the contact thereon, or of some other component with this contact thereon, and on the other hand of a strip having the counter-contact fixed thereto, the counter-contact and the contact are moved along paths with different radiuses, and because of this the counter-contact and the contact are moved and slipped over each other and are rubbed against each other with the effect that any dirt or coating produced by a process of corrosion will be rubbed off and the electrical connection will be kept in good working order, that is to say so that there is the lowest possible contact resistance. To make the lengths of the arms of the contact and of the counter-contact different, more specially in the event of the points of support thereof on the supporting part being at the same distance, it is possible, in keeping with a preferred form of the invention, for the bitmetallic element and/or the counter-contact strip to be ribbed so as to make the free moving lengths thereof different, the said element and/or the strip being stiff in these ribbed parts so that they are not elastic or able to be moved. If for this reason the counter-contact is for example fixed on a long strip, that is supported on the supporting part at a greater distance from the counter-contact the freely swinging length of lever arm may be cut down by such a ribbed structure. In the part thereof in which it is ribbed, the strip is stiff and not elastic and it is only in the part that is not ribbed or otherwise specially shaped or formed and which is shorter in length that the strip is able to be whipped backwards and forwards.

In the prior art thermal switches for making and breaking electrical connections and which have been made in one unit with more than one function such as the function of an automatic temperature controller together with that of a thermal protection device, have generally speaking been biased on the use of two different units that are simply placed side by side or one on top of the other in a housing. Such devices are not very economic in manufacture and in fact are quite as complex to make and in use as two separate switches. It would for this reason be rewarding if a thermal switch might be so designed that, while hardly being any more complex than known thermal switches, it might be used for the two said functions. In keeping with one form of the invention the design is for this reason such that the counter-contact, that as such is fixed in position and is only supported so that it may elastically give way, has a separate bimetallic element for switching it. In the case of this form of the invention there is only one contact and one counter-contact (even although the switch is designed for functioning in two different ways) unlike prior art devices that have to have two contacts and two counter-contacts, of which two are joined electrically with each other all the time, whereas the two others are only joined with the terminal elements running out of the switch. On the other hand in the present invention the contact and the counter-contact are to be switched by different bimetallic elements. More specifically, in this form of the invention one bimetallic element has a current flowing therethrough and takes the form of a current-sensitive switch, and the other is not loaded electrically and is only switched on a change in the temperature of the surroundings taking place. In this respect the bimetallic element, that is not loaded by a current flowing through it and is only temperature sensitive, may take the form of a thermostat or automatic controller for controlling the supply of current to a refrigeration apparatus or a heater, whereas the other bimetallic element has the function of breaking the circuit when the level of current flowing therethrough becomes overly high, for example when there is a short circuit, so that there is a safeguarding or protection function. In this respect it may have a highly accurate adjustment of the point at what load or what current level the switch is turned off and for how long. In adjustment of, or designing for, different groups of switching properties and conditions of the two bimetallic elements a very wide range of different combinations is possible.

Further useful effects and details of the invention will be seen from the claims and more importantly from the account now to be given of three working examples of the device in keeping with the invention using the figures herein.

DETAILED ACCOUNT OF WORKING EXAMPLES OF THE INVENTION

Figure 1:
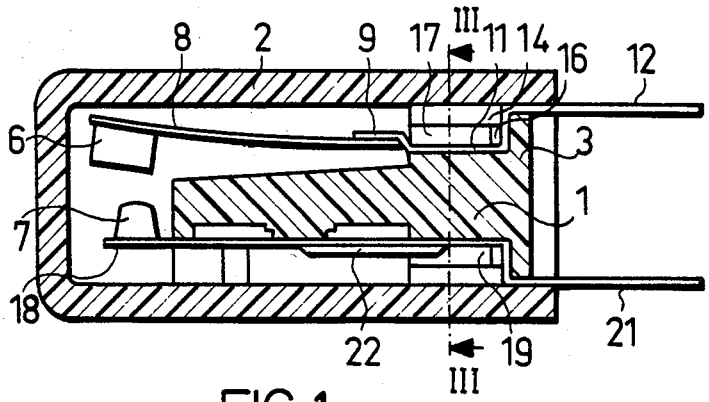
FIG. 1 is a view of a first working example of the device of the invention in the circuit-open condition thereof.

My device for thermally switching an electric current, that is to say a thermal automatic controller, regulator, thermostat or thermal protection switch or the like, has a supporting part 1 for the main switch elements. The device may be placed in a housing 2, as is in fact the case with the form to be seen in the figures; however a housing is not needed in all cases, for example in the event of the device being placed in a hollow or hole in the apparatus that is to be thermally switched or thermally safeguarded. To this end the device has a head plate 3 at one end of the supporting part 1 so that the opening for the device in the apparatus would be fully shut off by the plate. Such a way of mounting a thermal switching device is to be seen for example in the German Pat. No. 2,916,639 (see more specially FIGS. 1 and 3 thereof). In fact a switch in keeping with the present invention might be placed in such a hollow as in said patent.

On the one hand the device in keeping with the invention has a moving contact 6 and on the other hand it has a counter-contact 7 placed for use with the contact 6. The last-named is formed at the front end of a long and thin (or in other words elongated) tongue-like bimetallic element 8, fixed for example by welding at its back end 9 on a connection piece 11. The connection piece 11 is formed at one end as a terminal element 12 running out to the right from the head plate 3 of the supporting part 1. The contact unit as formed by the parts 6, 8, 9 and 11 might be rivetted or screwed permanently to the supporting part, that is made of insulating material, such rivetting being for example at the connection piece 11. However, be this as it may, in my present working example the method of assembly is different to this inasfar as the supporting part 1 has upwardly and inwardly running lips 14 and 14' on its middle part 13 at the edges thereof, such lips being undercut at 16 and 16' by grooves next to the middle part 13 (see FIG. 3). On the connection piece 11 there are edge parts 17 and 17' that are bent out of the plane of the piece 11 in an upward direction by an amount that is somewhat greater than the height of the undercuts or grooves 16 and 16'. The unit made up of the parts 6, 8, 9, 11 and 12 has its connection piece 11 (with the upwardly bent edges 17 and 17') so pushed into the undercuts 16 and 16' formed in the supporting part 1 that the connection piece 11 (in the more limited sensing of the wording) with its upwardly bent edges 17 and 17' is gripped and kept in position by the lips 14 and 14'. This design, that is used as well for keeping the counter-contact 7 in position on the supporting part 1 in generally the same way (so that no separate account is needed of this in detail) makes manufacture of the device very simple with marked economics in the use of materials and furthermore the device is very simple to put together.

Figure 3:
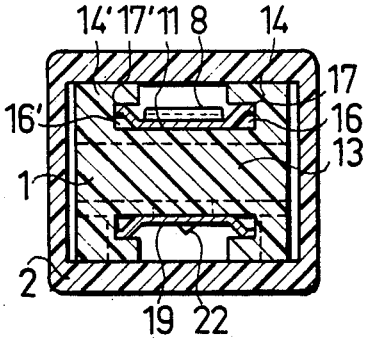
FIG. 3 is a section taken on the line III—III of FIG. 1.

The counter-contact 7 is formed at the front (left) end of a counter-contact strip 18, that is part of a bridging piece 19 much like the connection piece 11 to be seen in FIG. 3 and is designed running out from the supporting part 1 to the right as an integral electrical terminal element 21 for forming a counter-contact unit 7, 18, 19 and 21. Putting it differently, the terminal is fixed in position on the supporting part 1 in much the same way as noted in connection with the contact unit 6, 8, 9, 11 and 12.

The counter-contact strip 18 is made up of a piece of metal that is of an elastic nature. Because, as we have seen earlier, it is only fixed at one end, that is to say to the bridging piece 19, the counter-contact 7 is able to give way freely when acted upon by any force because the counter-contact strip 18 is moved elastically back from the supporting part 1. To make it possible for the designer to make an adjustment of the force needed for such bending back on the one hand and for adjustment of the length of the counter-contact strip 18 on the other hand that may be actively bent at all, the last-named may be pressed with a stiffening rib 22 running along it.

In FIG. 1 the reader will see a preferred example of my device in a position in which contact is broken, this generally being the high temperature condition, in which the temperature is over a given limit so that the flow of current is switched off. At this high temperature the bimetallic element 8 is bent in the way to be seen in FIG. 1, it lifting on so doing the contact 6 clear of the counter-contact 7 so that the current is turned off. If the temperature now goes down again under the said given limit, the bimetallic element 8 is snapped out or simply bent out of its position to be seen in FIG. 1, it so moving the contact 6 down against the counter-contact 7. At the normal temperature of the surroundings the bimetallic element 8 will be bent so far that the contact 6 comes into contact with the counter-contact 7, but goes no further, so that this takes place without the contact 6 applying an overly great force on the said counter-contact 7 and the same will hardly be moved out its position as shown in FIG. 1.

If however the temperature is a very low, the bimetallic element 8 will be bent further downwards forcing the contact 6 with a greater force against the counter-contact 7. In my invention this is possible because of the elastic way in which the counter-contact 7 is supported in place using the elastically bending counter-contact strip 18; that is to say the strip 18 may be bent back and give way before the effect of the force of the bimetallic element 8. This makes certain on the one hand that at such very low temperatures there is no chance of the degree of bending of the bimetallic element becoming overly great, while on the other hand its bending is limited by its resting against a fixed stop. Otherwise the high stressing of the bimetallic element at such lower temperatures might be the cause of damage of the bimetallic element, due to plastic deformation and, more importantly, cause great changes in the switching temperature.

With my invention it is possible to an make certain that the tolerance or limit for the switching temperature of the bimetallic element 8 is kept to unchanged value under all possible working conditions.

The bending or rocking of the bimetallic element 8 takes place along the full length thereof stretching from the end 9 fixed to the connection piece 11 to the contact 6. On the other hand, when acted upon by a force the springing back of the counter-contact strip 18 is only possible along a shorter part thereof between the counter-contact 7 and the right end of the stiffening rib 22. The free springing or resilient lengths of the bimetallic element 8 on the one hand and of the counter-contact strip 18 on the other hand are for this reason different. Because this is so, when the contact 6 comes up against the counter-contact 7 forcing the last-named back downwards, the contact 6 and the counter-contact 7 are not always in contact at the same point and in fact the two contacts are moved and rubbed against each other. Because of this rubbing or friction effect any undesired insulating coatings, such as coatings produced by oxidation or the like, on the two contact faces of the contact 6 and of the counter-contact 7 and any other form of contamination will be rubbed off so that one may be certain of there being a trouble-free and complete electrical connection in the shut position of the contacts at all times. There is more likely to be such oxidation or contamination effect when the device in keeping with the invention is not placed in a separate housing of its own, but is simply placed in some form of hollow in part of a motor or the like.

Figure 2:
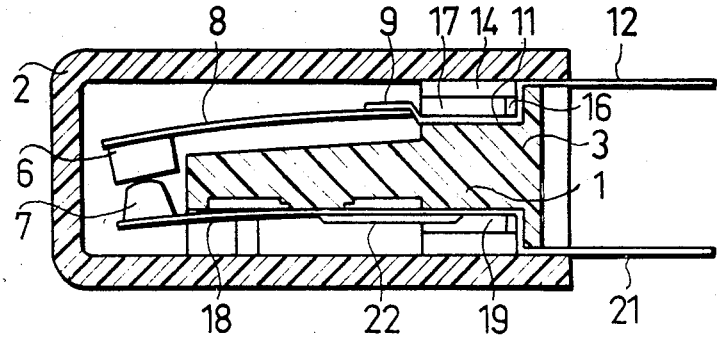
FIG. 2 is a further view of the device of FIG. 1, but this time in the closed condition.
Figure 4:
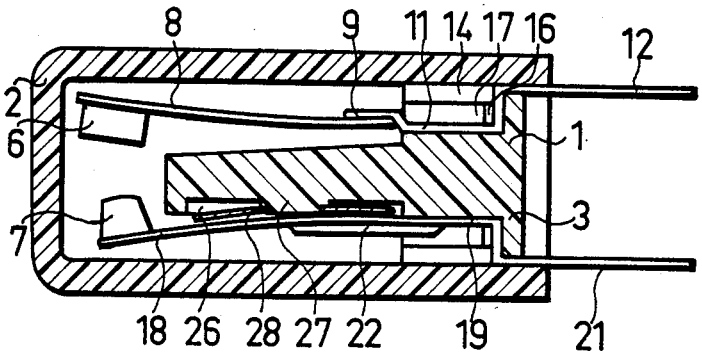
FIG. 4 is a view of a further preferred form of the invention with two switch elements in the open position thereof.
Figure 5:
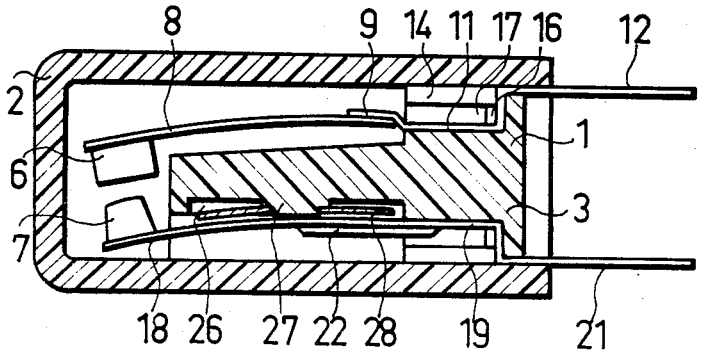
FIG. 5 is a view of the working example as in FIG. 4 with one switching element in its cir cuit-closed position, even although the circuit is broken by the other switching element being in its circuit-open condition.
Figure 6:
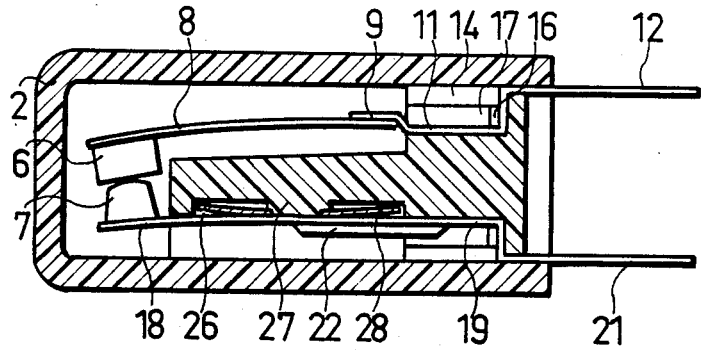
FIG. 6 is a view of the device of FIG. 4 with the two switch elements in their circuit-completed condition.

The form of the invention to be seen in FIGS. 4 to 6 has two switching elements in place of the single bimetallic element 8 in the device in FIGS. 1 to 3. In the case of this form with two elements, the one switching element may for example have the function of an automatic temperature controller by moving backwards and forwards within certain temperature ranges, whereas the other switching element, like the bimetallic element 8, is only used for over-temperature protection. It would furthermore be possible for one switching element only to be responsive to the temperature of the surroundings, whereas the other switching element, like the bimetallic element 8, would be sensitive to overcurrents, that is to say, because of the heating effect of the current therein the circuit would be broken. A detailed account of the form of the invention of FIGS. 4 to 6 will now be given using the same part numbers as in FIGS. 1 to 3 and further numbers, such account being in fact limited to those parts that are different to those parts which are not used in the said FIGS. 1 to 3.

In the form of the invention of FIGS. 4 to 6 the support 1 has a round hollow 26 (that is present in the device of FIGS. 1 to 3 but has no function therein) on the side thereof with the counter-contact strip 18. The hollow 26 has middle locating head 27 and takes up a generally ring-like bimetallic washer or disk 28 seated in place between the supporting part 1 and the counter-contact strip 18. The bimetallic disk 28 is located by the locating head 27 and kept in place thereby. The said disk 28 is in this respect so placed in position that it is unloaded in its lower temperature position (see FIG. 6) and more specially lets motion of the counter-contact strip 18 take place freely till the said strip comes up against the supporting part 1, whereas in its high temperature position (see FIGS. 4 and 5) it inner edge is resting against the support part 1 and its outer edge is against the counter-contact strip 18 forcing it for this reason away from the supporting part 1 in a downward direction so that contact 7 is moved clear of contact 6 and in fact the electrical connection with the contact 6 is broken.

The working example of FIGS. 4–6 is so designed that the switching temperature of the bimetallic element 8 of the contact 6 is over the switching temperature of the bimetallic disk 28. In FIG. 4 the bimetallic element 8 and the bimetallic disk 28 are to be seen at a temperature that is greater than both the switching temperatures, the bimetallic element 8 lifting the contact 6 back upwards and so causing the first part of an electrical separation. In the same way the counter-contact strip 18 (and with it the counter-contact 7) is moved by the bimetallic disk 28 downwards so that the contacts 6 and 7 are separated electrically. If now for example the temperature of the surroundings goes down to a value under the switching temperature of the bimetallic element 8, but still keeps to a value over the switching temperature of the bimetallic disk 28, the bimetallic element 8 will snap out of the position of FIG. 4 into the position of FIG. 5 so that the contact 6 is moved into its own specific contacting position. The circuit is however kept open by the bimetallic disk 28 in its high temperature position forcing the counter-contact away from the contact 6 so that there is no contacting effect. If now the temperature of the surroundings goes down still further to a value under the switching temperature of the bimetallic disk 28, the last-named will snap into its low temperature position to be seen in FIG. 6, it so unloading or relieving the counter-contact strip 18 so that the same will be whipped back into its own specific, circuit-completed position. For this reason the counter-contact 7 comes into contact with the contact 6 of the bimetallic element 8.

On the temperature decreasing still further and causing a further bending downwards of the bimetallic element 8, the counter-contact 7 may give way freely in a downward direction under the effect of the contact 6, as was made clear earlier in connection with the device of FIGS. 1 to 3.

As noted, it is more specially not necessary for the bimetallic element 8 to be switched under the effect of the temperature of the surroundings. The elements 8 may switch by itself because of the flow of current therethrough and the heating effect caused thereby.

Furthermore when the two bimetallic elements 8 and 28 are so placed that in their high temperature positions they part the two contacts 6 and 7, the system can be so designed that the distribution of their switching temperatures is not such that the switching temperature of the bimetallic element 8 is higher than that of the bimetallic disk 28. For example, if switching temperature of the bimetallic disk 28 in the device figured with the two elements were to be higher than that of the bimetallic element 8, then at a temperature of the surroundings between the two switching temperatures the bimetallic element 8 would keep on in its position as in FIG. 4, whereas the bimetallic disk 28 and for this reason the counter-contact strip 18 with its counter-contact 7 would go into the position as in FIG. 6, the bimetallic element 8 all the same breaking the electrical circuit.

A further point is that the two bimetallic elements 8 and 28 do not have to be placed exactly as in the figure so that in their high temperature positions they force the two contacts 6 and 7 away from each other. To take an example, at the desired switching temperatures for a refrigeration apparatus the bimetallic disk 28 might be so placed that its position to be seen in FIGS. 4 and 5 would be the position under the switching temperature, that is to say the low temperature position, and the position as marked in FIG. 6 would be the high temperature position and the position to be seen in FIGS. 5 and 6 of the bimetallic element 8 would be the position for a normal flow of current. Furthermore the position marked in FIG. 4 of the bimetallic element 8 would be the overcurrent position, caused for example by a short-circuit. The function of the device would then be such that when a normal current is going through the device the bimetallic element 8 with the contact 6 would be in the position as in FIGS. 5 and 6 as a normal operation position. If the temperature of the surroundings is low enough (it is a question of a refrigeration system), the bimetallic disk will be in the position of FIG. 5, it then cutting off the current to the refrigeration plant. If the temperature now goes up, the bimetallic disk 28 will spring into the position as in FIG. 6 and lets the circuit be completed and the refrigeration plant may be run. If because of some trouble condition there is an overcurrent, the bimetallic element 8 will be snapped out of the position of FIG. 6 upwards because of the heating effect of the current in it and the contacts 6 and 7 will be parted (although in fact the temperature of the surroundings is such that refrigeration is needed).

Figure 7:
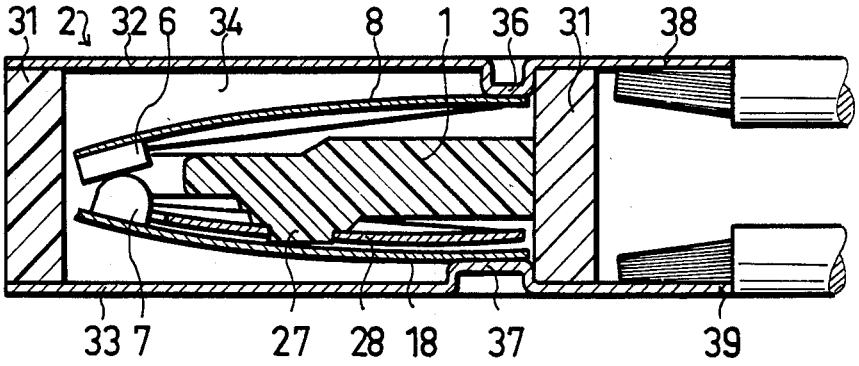
FIG. 7 is a section of a further, generally round form of the device in keeping with the invention.
Figure 8:
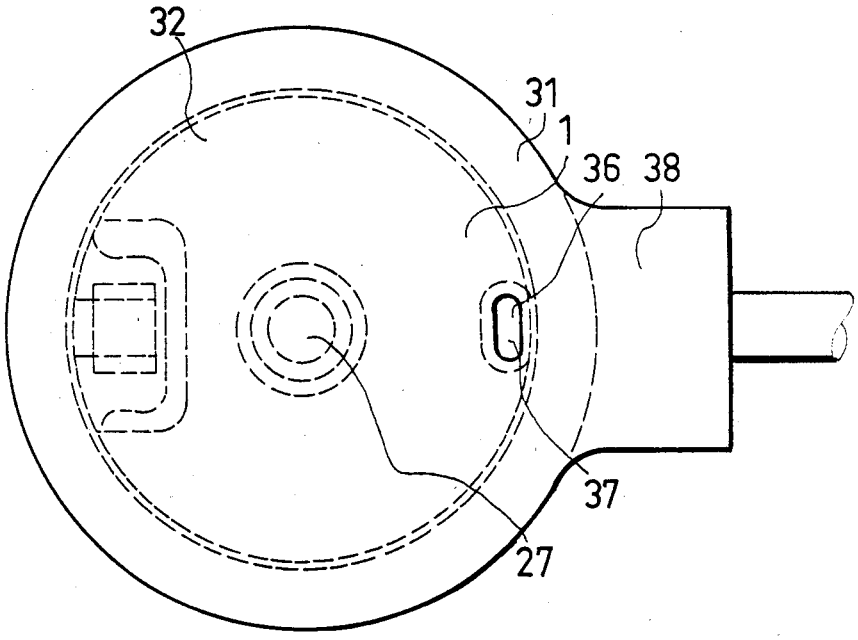
FIG. 8 is a partly broken away view of the device of FIG. 7 looking in a downward direction.

The further form of the invention to be seen in FIGS. 7 and 8 is more specially of value when it comes to having the switching elements sealed off completely in a housing, as when for example the device is needed in a refrigeration compressor and is placed within the body of refrigerant fluid.

In respects in which the parts of the device are the same as used in earlier forms of the invention the same part numbers are used, as has been the case with the device of FIGS. 4 to 6 and FIGS. 1 to 3.

The device of FIGS. 7 and 8 as well has a supporting part 1. This supporting part 1 has an outer part in the form of a ring 31. On the two sides on the ring 31 there are metal housing covers 32 and 33, that are fixedly joined to the ring walling in a sealed space 34. The connection and the sealing effect desired between the ring and the covers may be produced in a number of different ways, as for example by having the edge of the covers 32 and 33 crimped round into outer grooves of the ring 31. However a further possible design would be one in which the ring 31 is metallized at its end faces and is in the form of an insulating aluminum oxide structure, the housing covers 32 and 33 being soldered or otherwise joined to the ring. The housing covers 32 and 33 have dent structures 36 and 37 on which the bimetallic element 8, that is round as well, and the counter-contact strip 18 are fixed, as for example by soldering. The locating head 27 is formed on the supporting part 1 and is used for locating and generally keeping in place the bimetallic disk 28 acting on the counter-contact strip 18 and for this reason moving the counter-contact 7. The two housing covers 32 and 33 have terminal lugs 38 and 39. It is to be noted that in this form of the invention as well the free length of the bimetallic element 8 and of the counter-contact strip 18 may be made changed by changing (as part of the process of design and manufacture) the position and form of the dent structures 36 and 37. But for the design differences in the figures as noted, the operation of the device of FIGS. 7 and 8 is the same as in the earlier forms of the invention, more specially the forms of FIGS. 4 to 6 with the second bimetallic disk 28 so that no separate account is needed in this respect.

The device in keeping with the invention with its main details of design may be changed in a number of different ways. For example, there might be no flow of current through the bimetallic element 8 itself and the way of supporting and positioning the contact 6 might be different using adjustable knife edge supports or resilient snap-action disks designed for conducting the current at the very point of contact, whereas the bimetallic element in the form of the bimetallic disk 28 would not be used for conducting current by only for causing the switching function. Furthermore, it is generally possible to use the device of the present invention in switching systems which are disclosed in my other patent applications and patents.

The details of the invention, and the ideas on which they are based, as given in the present specification, figures and claims, may be used separately or in any combination for effecting the purpose of the invention in the different possible forms thereof.

I claim:

1. A device based on thermal expansion for electrical switching purposes, comprising an insulating supporting part, a bimetallic element, means supporting said bimetallic element on said support part adjacent one end of said bimetallic element with the opposite end of said bimetallic element being completely free for movement with temperature changes, a moving contact mounted on the free end of said bimetallic element for movement relative to a counter-contact, said moving contact and said counter-contact being designed to be switched by said bimetallic element on the temperature changing past a certain limit, spaced first and second terminal elements for connection of leads to said contacts, said first and second spaced terminal elements being common to said moving contact and said counter-contact, respectively, and wherein means are provided in the form of a passive spring member for elastically and givingly supporting said counter-contact on said supporting part for movement in a direction away from said moving contact in response to a force against the counter-contact by the bimetallic element and moving contact with further temperature change after the the temperature has changed past said certain limit whereby damage to the bimetallic element and substantial change in said certain temperature limit caused thereby can be avoided.

2. The device as claimed in claim 1 further comprising a long and narrow elastic strip as said passive spring member with the counter-contact being supported on one end thereof, a first part of said strip spaced from said counter-contact being supported on the supporting part, said elastic strip being fixed to said supporting part frictionally, said bimetallic element being long and narrow as well and having said moving contact on its one end and being fixed at a fixing part thereof frictionally on said supporting part, said fixing part being spaced from said contact.

3. The device as claimed in claim 2 wherein said elastic strip is made integrally with said second terminal element, said device further comprising a conducting part joined with said bimetallic element, said conducting part being on the one hand fixed frictionally on said supporting part and on the other hand formed integrally with said first terminal element for the moving contact.

4. The device as claimed in claim 2 wherein said bimetallic element and said elastic strip have different movable lengths.

5. The device as claimed in claim 4 wherein said elastic strip has at least one stiffening rib for decreasing the length thereof which may elastically move.

6. The device as claimed in claim 1 comprising a further bimetallic element located between said supporting part and said passive spring member for moving said passive spring member.

7. The device as claimed in claim 1, further comprising a housing having a generally ring-like form, said supporting part having an outer part designed as a ring of said housing, covers being provided on said ring of said housing, said covers functioning as joining elements and being round in form with terminal lugs formed thereon.

8. A device based on thermal expansion for electrical switching purposes, comprising an insulating supporting part, a bimetallic element, means supporting said bimetallic element on said support part, a moving contact mounted on said bimetallic element for movement relative to a counter-contact, said moving contact and said counter-contact being designed to be switched by said bimetallic element on the temperature changing past a certain limit, spaced first and second terminal elements for connection of leads to said contacts, said first and second spaced terminal elements being common to said moving contact and said counter-contact, respectively, and wherein means are provided in the form of a passive spring member for elastically and givingly supporting said counter-contact on said supporting part for movement in a direction away from said moving contact in response to a force against the counter-contact by the bimetallic element and moving contact whereby damage to the bimetallic element and substantial change in said certain temperature limit caused thereby can be avoided, and wherein said support part is in the form of a ring-like part, said bimetallic element for moving said moving contact being generally round in form and being supported on an outer edge thereof on said supporting part, and further comprising a disk spring as said passive spring member, the counter-contact being supported on an outer edge of said disk spring.

9. A device based on thermal expansion for electrical switching purposes, comprising an insulating supporting part, a bimetallic element, means supporting said bimetallic element on said support part, a moving contact mounted on said bimetallic element for movement relative to a counter-contact, said moving contact and said counter-contact being designed to be switched by said bimetallic element on the temperature changing past a certain limit, spaced first and second terminal elements for connection of leads to said contacts, said first and second spaced terminal elements being common to said moving contact and said counter-contact, respectively, and wherein means are provided in the form of a passive spring member for elastically and givingly supporting said counter-contact on said supporting part for movement in a direction away from said moving contact in response to a force against the counter-contact by the bimetallic element and moving contact whereby damage to the bimetallic element and substantial change in said certain temperature limit caused thereby can be avoided, and further comprising a long and narrow elastic strip as said passive spring member with the counter-contact being supported on one end thereof, a first part of said strip spaced from said counter-contact being supported on the supporting part, said elastic strip being fixed to said supporting part frictionally, said bimetallic element being long and narrow as well and having said moving contact on its one end and being fixed at a fixing part thereof frictionally on said supporting part, said fixing part being spaced from said contact, wherein said elastic strip is made integrally with said second terminal element, said device further comprising a conducting part joined with said bimetallic element, said conducting part being on the one hand fixed frictionally on said supporting part and on the other hand formed integrally with said first terminal element for the moving contact, and wherein said supporting part is formed with lips having groove-like undercuts, said connection piece joined with said bimetallic element being formed with edges bent out of its plane and being so fitted into the said undercuts between the lips and a middle part of the supporting part that said edges are gripped in said undercuts and said connection piece is rested on and kept in place against said middle part of said supporting part, said elastic strip having edge rims like said edges, said rims being grippingly kept in place in further undercuts of further lips on a side of said supporting part opposite to said first lips.

10. A device based on thermal expansion for electrical switching purposes, comprising an insulating supporting part, a bimetallic element, means supporting said bimetallic element on said support part, a moving contact mounted on said bimetallic element for movement relative to a countercontact, said moving contact and said counter-contact being designed to be switched by said bimetallic element on the temperature changing past a certain limit, spaced first and second terminal elements for connection of leads to said contacts, said first and second spaced terminal elements being common to said moving contact and said counter-contact, respectively, and wherein means are provided in the form of a passive spring member for elastically and givingly supporting said counter-contact on said supporting part for movement in a direction away from said moving contact in response to a force against the counter-contact by the bimetallic element and moving contact whereby damage to the bimetallic element and substantial change in said certain temperature limit caused thereby can be avoided, and comprising a further bimetallic element located between said supporting part and said passive spring member for moving said passive spring member, wherein said further bimetallic element is in the form of a bimetallic disk with a round outer edge, said disk being placed in a ring-like hollow in said supporting part between said supporting part and said passive spring member.

11. The device as claimed in claim 10 wherein said bimetallic disk is generally round in form with an opening in the middle thereof, said device on said supporting part having a middle locating head for locating said disk.

12. A device based on thermal expansion for electrical switching purposes, comprising an insulating supporting part, a bimetallic element, means supporting said bimetallic element on said support part, a moving contact mounted on said bimetallic element for movement relative to a countercontact, said moving contact and said counter-contact being designed to be switched by said bimetallic element on the temperature changing past a certain limit, spaced first and second terminal elements for connection of leads to said contacts, said first and second spaced terminal elements being common to said moving contact and said countercontact, respectively, and wherein means are provided in the form of a passive spring member for elastically and givingly supporting said counter-contact on said supporting part for movement in a direction away from said moving contact in response to a force against the counter-contact by the bimetallic element and moving contact whereby damage to the bimetallic element and substantial change in said certain temperature limit caused thereby can be avoided, wherein said terminal elements are designed in the form of housing covers, said supporting part being made in the form of a housing wall, said bimetallic element and said passive spring member each being joined with a housing cover.

13. The device as claimed in claim 11 wherein the bimetallic element and the passive spring member are joined to said housing covers at dent structures formed in said housing.

* * * * *